US009604107B1

(12) United States Patent
Wilson

(10) Patent No.: US 9,604,107 B1
(45) Date of Patent: Mar. 28, 2017

(54) SCOOP AND GO GOLF BALL RETRIEVER

(71) Applicant: Victor Allen Wilson, Arlington, TX (US)

(72) Inventor: Victor Allen Wilson, Arlington, TX (US)

( * ) Notice: Subject to any disclaimer, the term of this patent is extended or adjusted under 35 U.S.C. 154(b) by 0 days.

(21) Appl. No.: 15/146,772

(22) Filed: May 4, 2016

(51) Int. Cl.
*A63B 47/02* (2006.01)

(52) U.S. Cl.
CPC ..... *A63B 47/024* (2013.01)

(58) Field of Classification Search
CPC ..... A63B 47/02; A63B 47/025; A63B 47/024; E01H 1/1206; A01K 23/005; A01K 1/0107; A47L 13/52
USPC ..... 294/19.2, 1.4, 1.5; 473/286, 460; 119/161, 867; 15/104.8, 257.1, 257.6, 15/257.7, 257.9
See application file for complete search history.

(56) References Cited

U.S. PATENT DOCUMENTS 1,056,572 A * 3/1913 Nadeau ..... F24B 15/04 220/2
4,307,704 A * 12/1981 Wagg ..... F24B 13/006 126/243
4,361,245 A * 11/1982 Allen ..... F23J 1/04 15/257.6
4,457,548 A * 7/1984 Robins ..... F24B 1/1915 294/177
4,572,560 A * 2/1986 Grandlouis ..... F23J 1/04 294/177
5,513,883 A * 5/1996 Segla ..... F23J 1/04 294/177

* cited by examiner

*Primary Examiner* — Stephen Vu

(57) ABSTRACT

A cylindrical tubular or rectangular shaped box, designed specifically to allow for the retrieval of a golf ball from golf course fairways, grassy fringe areas, and other non-water areas around a golf course. More specifically, a device designed for the retrieval of golf balls while one using the device remains seated on a golf cart.

1 Claim, 2 Drawing Sheets

SCOOP AND GO GOLF BALL RETRIEVER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention generally relates to golf equipment designed for retrieving golf balls. This invention relates more specifically and particularly to a golf ball retrieving device designed especially for retrieving or picking up golf balls while one is seated on a golf cart.

This invention is specifically designed to allow one using it to remain seated on a golf cart while retrieving a golf ball from a land surface. It is not a device designed for retrieving a golf ball from water or other hazards. This invention is designed to aid its' user to retrieve a golf ball from the ground surface without the need to leave a golf cart. This invention is designed to allow its' user to pick up a golf ball from the ground surface without having to bend ones' back and lean out of the golf cart to pick up a golf ball with one's hand during the ball retrieval process.

While there currently exists various types of golf ball retrieval devices on the market, they are primarily designed for the retrieval of a golf ball from water. Golf ball retrieval devices currently on the market differ from this device in several ways, such as to make this a totally unique and different product than any golf ball retrieval device currently available. More of the specific differentiations of this device to other golf ball retrieval devices currently available; this device is designed to retrieve multiple golf balls within a cylindrical tubular or rectangular shaped box compared to other hand held retrieval devices designed to retrieve and hold only one golf ball at a time; this device is designed to allow its' user to scoop the golf ball from the surface of the ground while seated on a stationary or moving golf cart; this device is designed with a short length attached handle specifically for seated golf ball retrieval compared to other golf ball retrieving devices designed with longer, often telescoping, handles attached to cup typed devices designed and marketed for the retrieval of a golf ball from water. Other such devices are designed to be used while one using the device is in a standing position.

BRIEF SUMMARY OF THE INVENTION

The Scoop and Go Golf Ball Retriever stands apart and is completely different, in purpose and usage, from all prior devices designed for the stated purpose of golf ball retrieval. The Scoop and Go Golf Ball Retriever is designed with a cylindrical tubular or rectangular shaped box retriever which is designed to allow for retrieval of multiple golf balls without one having to remove a ball from the container. Prior art is primarily of a design type comprising a cup shaped device designed for the retrieval of a single golf ball at a time and requiring the device to be emptied prior to additional golf ball retrieval.

The Scoop and Go Golf Ball Retriever is designed with an opening sufficiently large enough to allow one to scoop golf balls into the cylindrical tubular or rectangular shaped box while one continues to move in a forward direction towards the target golf ball, without requiring one to stop and rotate the container device over to secure the golf ball within.

The Scoop and Go Golf Ball Retriever is designed with a fixed static non swivel short handle attached to the top upper most side of the cylindrical tubular or rectangular shaped box ball retriever designed such that one can remain seated on a golf cart while in the act of retrieving a golf ball.

The Scoop and Go Golf Ball Retriever is designed with an inward opening door panel device, hinge connected to the topside of the cylindrical tubular or rectangular shaped box retriever which allows golf balls to be scooped into the container.

The Scoop and Go Golf Ball Retriever is designed with peg tips along the outer edge which prevents the golf balls from rolling out of the cylindrical tubular or rectangular shaped box by preventing the hinged inward opening door from swinging outward. This feature prevents the golf balls from falling out of the retrieval container during the retrieval process.

DETAILED DESCRIPTION OF THE INVENTION

Now referencing specifically the drawings to aid in describing the present invention:

It is quite possible to construct or manufacture this invention using a variety of materials and methods. The invention is also susceptible to various modifications. The drawings depicting the invention and these subsequent detailed descriptions of the drawings are not intended to place limitations on the claims of the inventor. These drawings and their descriptions are in no way intended to limit the invention to the specific form disclosed. This invention is, however, intended to cover all modifications, methods, and alternative constructions and any subsequent equivalents within the spirit of the invention as described and claimed.

Figure 1:
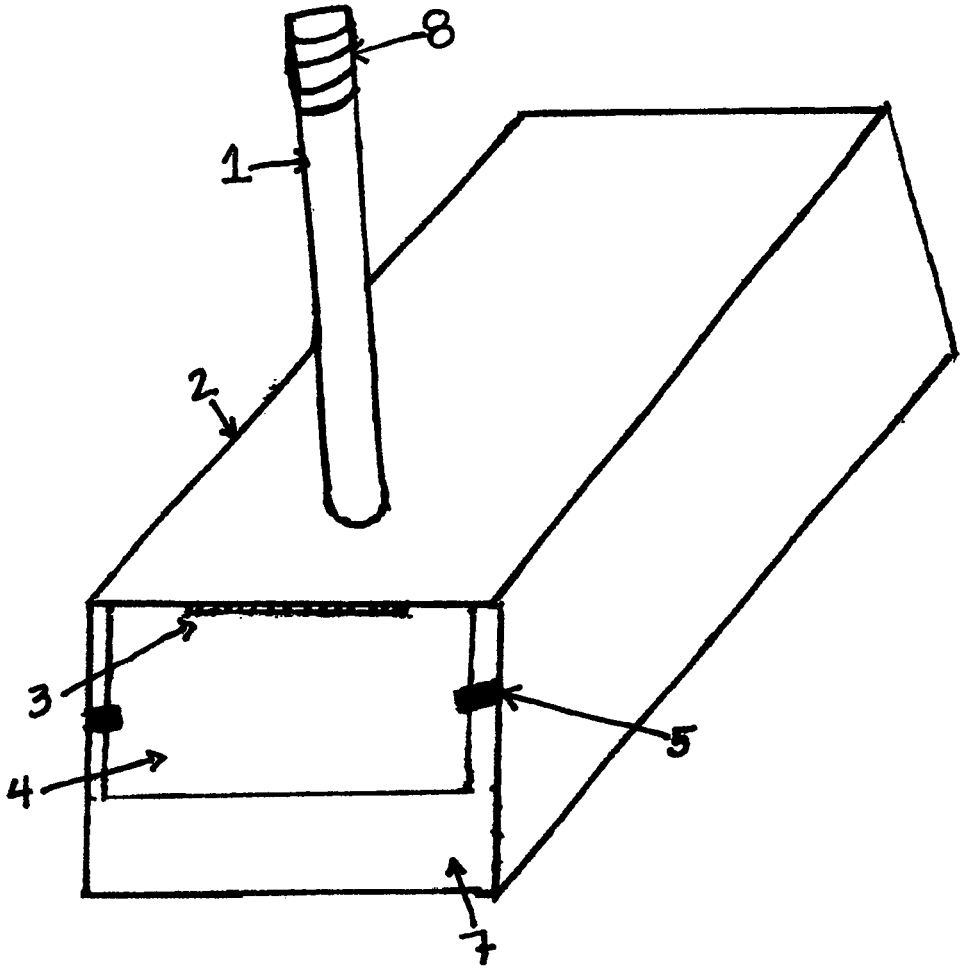
FIG. 1 represents the front, top, right side view, the front door panel, the connecting hinge, the handle and handle grip of the Scoop and Go Golf Ball Retriever.
Figure 2:
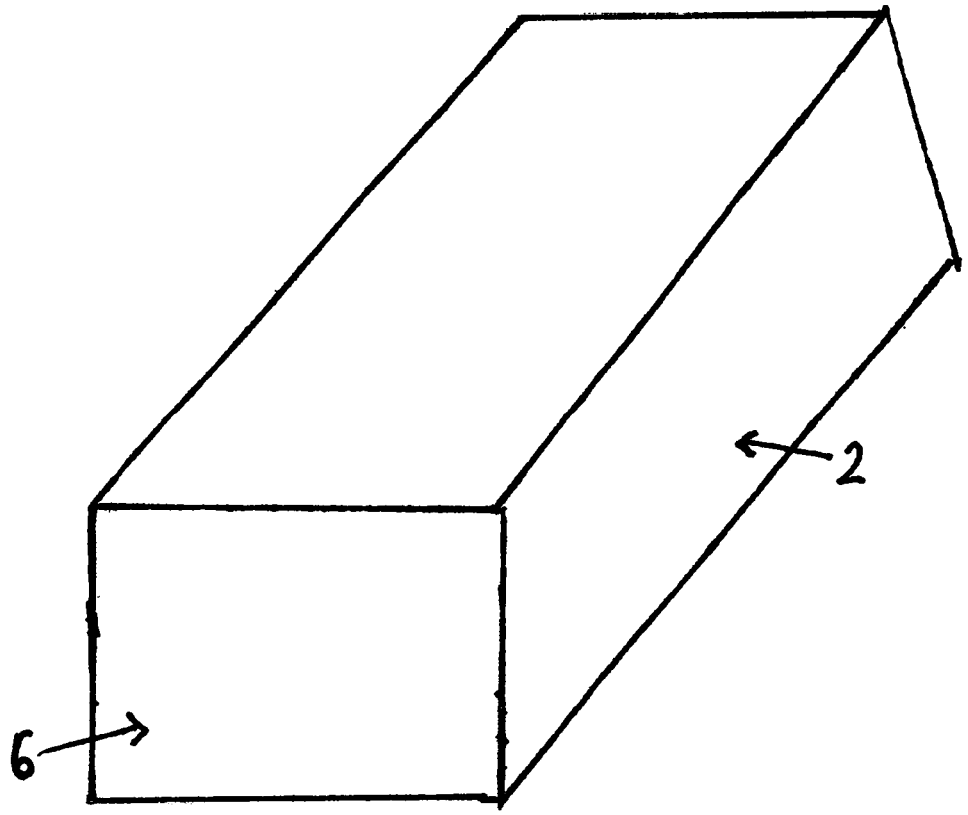
FIG. 2 represents the rear, top and left side view of the Scoop and Go Golf Ball Retriever.

The cylindrical tubular or rectangular shaped box retriever (2) depicted in FIG. 1 and FIG. 2, the Handle (1) depicted in FIG. 1, the Door (4) depicted in FIG. 1, the Pegs (5) depicted in FIG. 1, and the Rear Panel (6) depicted, in FIG. 2, is to be constructed of a lightweight, solid, durable material so as to provide for long term usage for the repeated action of scooping up and retrieving golf balls. The preferred material for manufacture is a solid hard durable plastic, light weight stainless or coated steel, aluminum, or similarly durable material.

FIG. 1 depicts the open area (7) space designed through which to allow a golf ball to roll into the cylindrical tubular or rectangular shaped box (2) depicted in FIG. 1. The hinge (3) depicted in FIG. 1 is to be constructed of steel, aluminum or similarly durable material.

The handle (1) in FIG. 1 is to be attached to the cylindrical tubular or rectangular shaped box golf ball retriever (2) in FIG. 1 in such a manner as to allow one using the Scoop and Go Golf Ball Retriever to lower the Scoop and Go Golf Ball Retriever to the ground and proceed in a forward sweeping motion towards a golf ball as to scoop it from the ground thereby retrieving it. The grip (8) in FIG. 1 is to be attached to the top of the handle to keep the handle secure from slipping when in use.

The door (4) depicted in FIG. 1 is to be attached to the cylindrical tubular or rectangular shaped box retriever (2) depicted in FIG. 1 using the hinge (3) depicted in FIG. 1 in such a manner as to allow the door (4) depicted in FIG. 1 to swing inward when struck by a golf ball being scooped during the retrieval process.

The door (4) depicted in FIG. 1 is to be designed and sized slightly smaller than the outer wall edges of the cylindrical tubular or rectangular shaped box retriever framing the opening area (7) as depicted in FIG. 1.

The open area (7) depicted in FIG. 1, through which golf balls are entered into the cylindrical tubular or rectangular shaped box golf ball retriever (2) FIG. 1 when scooped from the surface of the ground is represented on the open end of the cylindrical tubular or rectangular shaped box (2) depicted in FIG. 1.

The door (4) depicted in FIG. 1 is designed to hang in the open area (7) FIG. 1 attached to the top upper most side of (2) FIG. 1 via (3) a hinge depicted in FIG. 1 and designed to swing inward to the inner most side of (2) the cylindrical tubular or rectangular shaped box golf ball retriever to allow golf balls to be scooped in and thereby retrieved.

The peg stops (5) depicted in FIG. 1 are to be positioned along the outer open end walls or top panel of (2) depicted in FIG. 1 and attached thereto in a manner and fashion so as to prevent the door (4) FIG. 1 from swinging outward and releasing a golf ball.

I claim:

1. A Scoop and Go Golf Ball Retriever device comprising a rectangular-shaped compartment defining first and second sidewalls, a back wall, a top wall, a bottom wall, wherein each of the first and second sidewalls, bottom wall, and top wall further having a front edge defining a front opening into an interior space of the compartment;

a solid door configured to be smaller in size than the front opening and hingedly attached to the front edge of the top wall by a hinge pin, wherein allowing said door to swing freely from the front opening into the interior space of the compartment;

first and second peg stop elements each having a first end and a second end, wherein the first end of the first peg stop element being configured to be attached to the front edge of the first sidewall and the second end of the first peg stop element being configured to extend longitudinally across the front opening and engageable with a first side portion of the solid door, the first end of the second peg stop element being configured to be attached to the front edge of the second sidewall and the second end of the second peg stop element being configured to extend longitudinally across the front opening and be engageable with a second side portion of the solid door, whereby the first and second peg stop elements prevent the solid door from swinging or extending laterally outwardly beyond from the front opening;

a rod-shaped handle rigidly having a first end attached to the top wall in order to allow a user to control the device and swing the device in a scooping motion to retrieve and pickup one or more golf balls; and a grip snugly fitted on a second end of the rod-shaped handle.

* * * * *